US009725932B2

(12) United States Patent
Huang

(10) Patent No.: US 9,725,932 B2
(45) Date of Patent: Aug. 8, 2017

(54) TRANSMISSION MECHANISM OF HANDLE LOCK SET

(71) Applicant: TAIWAN FU HSING INDUSTRIAL CO., LTD., Kaohsiung (TW)

(72) Inventor: Chao-Ming Huang, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 154 days.

(21) Appl. No.: 14/565,551

(22) Filed: Dec. 10, 2014

(65) Prior Publication Data

US 2016/0168887 A1 Jun. 16, 2016

(51) Int. Cl.

| | |
|---|---|
| ***E05C 1/06*** | (2006.01) |
| ***E05C 1/14*** | (2006.01) |
| ***E05B 63/16*** | (2006.01) |

(52) U.S. Cl.
CPC ..... *E05C 1/14* (2013.01); *E05B 63/16* (2013.01)

(58) Field of Classification Search
CPC ..... Y10T 292/57; Y10T 70/5226; Y10T 74/18056; Y10T 292/0836; Y10T 292/0843; Y10T 70/7706; E05B 59/00; E05B 53/00; E05B 15/004; E05B 47/0004; E05B 47/0673; E05C 9/041
USPC ..... 292/138, 142, 336.3, 358, 359
See application file for complete search history.

(56) References Cited

U.S. PATENT DOCUMENTS

| | | | | |
|---|---|---|---|---|
| 5,088,778 | A | 2/1992 | Lin | |
| 8,491,019 | B2 * | 7/2013 | Uyeda | E05B 59/00 292/137 |
| 2006/0214436 | A1 | 9/2006 | Wheatland et al. | |

(Continued)

FOREIGN PATENT DOCUMENTS

| | | | |
|---|---|---|---|
| CN | 1287209 | A | 3/2001 |
| CN | 2010033984 | Y | 3/2008 |
| CN | 201756836 | U | 3/2011 |

(Continued)

OTHER PUBLICATIONS

Taiwanese Office Action mailed Dec. 29, 2014 for Taiwanese Patent Application No. 102120454, 5 pages.

(Continued)

*Primary Examiner* — Mark Williams
(74) *Attorney, Agent, or Firm* — Jackson IPG PLLC; Demian K. Jackson

(57) ABSTRACT

A transmission mechanism of handle lock set used for driving a latch to perform extension/retraction action includes a driving plate and a transmission plate. The driving plate includes a supporting portion having a transmission surface with an arc surface and a blocking surface with a flat surface. The driving plate is rotated to make the supporting portion swinging between a first position and a second position. The transmission plate further includes a protrusion having a contact surface. The transmission surface contacts the contact surface and pushes the protrusion to prevent the driving plate from being unavailable due to transmission dead spot occurrence when the supporting portion locates at the first position. The blocking surface contacts the contact surface of the protrusion to prevent the driving plate from over rotation for avoiding unavailable return when the supporting portion of the driving plate locates at the second position.

10 Claims, 10 Drawing Sheets

(56) References Cited

U.S. PATENT DOCUMENTS

2012/0025544 A1* 2/2012 Uyeda ..... E05B 59/00
292/145

FOREIGN PATENT DOCUMENTS

| | | | |
|---|---|---|---|
| CN | 103938944 | A | 7/2014 |
| TW | 126943 | | 1/1990 |
| TW | 141948 | | 9/1990 |
| TW | 188574 | | 8/1992 |

OTHER PUBLICATIONS

Chinese Office Action mailed Feb. 10, 2017 for Chinese Patent Application No. 201410689674.7, 5 pages.

* cited by examiner

TRANSMISSION MECHANISM OF HANDLE LOCK SET

FIELD OF THE INVENTION

The present invention is generally relating to a transmission mechanism of a handle lock set, particularly to the transmission mechanism of the handle lock set utilizes a driving plate to drive a transmission plate moving.

BACKGROUND OF THE INVENTION

Referring to U.S. Pat. No. 5,088,778 and FIGS. 11 to 13, a conventional transmission mechanism 400 of a handle lock set comprises a driving plate 410, a transmission plate 420 and a cover 430, wherein an end 411 of the driving plate 410 is used to push a cylinder 421 of the transmission plate 420 for moving upwardly. With reference to FIG. 12, when the transmission plate 420 reaches a transmission dead spot (that means the transmission plate 420 is in contact with top of the cover 430) in moving process, the driving plate 410 likely falls off from curved surface of the cylinder 421 as illustrated in FIG. 13 when user apply more powerful forces to rotate the driving plate 410 because the end 411 of the driving plate 410 contacts with curved surface of the cylinder 421 of the transmission plate 420. Thus, the driving plate 410 is not able to be pushed to return to original position by the transmission plate 420 and makes the transmission mechanism 400 of the handle lock set out of use.

SUMMARY

The primary object of the present invention is that a supporting portion of a driving plate comprises a transmission surface and a blocking surface, wherein the transmission surface is an arc surface and the blocking surface is a flat surface. The transmission surface pushes a protrusion of a transmission plate to prevent the driving plate from being unavailable due to transmission dead spot occurrence. Besides, the blocking surface contacts against a contact surface of the protrusion to prevent the driving plate from over rotation to make the driving plate can not return.

A transmission mechanism of a handle lock set used for driving a latch to perform extension/retraction action includes a driving plate and a transmission plate, wherein the driving plate comprises a main portion and a supporting portion, the main portion comprises a rotational center, the supporting portion comprises a transmission surface and a blocking surface, wherein the transmission surface is an arc surface, and the blocking surface is a flat surface. The driving plate rotates about the rotational center to make the supporting portion swinging between a first position and a second position. The transmission plate comprises a first surface and a protrusion protruded to the first surface, wherein the protrusion comprises a contact surface, the transmission plate is movable between a door-closed position and a door-opened position to drive a rotating member in rotation therefore simultaneously driving the latch. The transmission surface of the supporting portion contacts against the contact surface of the protrusion and the transmission plate is located at the door-closed position and the latch is in an extension state when the supporting portion of the driving plate is located at the first position The blocking surface of the supporting portion contacts against the contact surface of the protrusion and the transmission plate is pushed by the driving plate to move from the door-closed position to the door-opened position and drives the rotating member in rotation for making the latch operate in a retraction state when the supporting portion of the driving plate is located at the second position. Owing to the reason that the transmission surface is the arc surface, the occurrence of transmission dead spot is avoidable as a result of the supporting portion pushes the protrusion. Besides, owing to the reason that the transmission surface is an arc surface, the force that rotates a handle is effectively saved. In addition, owing to the supporting portion of the blocking surface contacting against the contact surface of the protrusion, over rotation of the driving plate is avoidable to prevent the driving plate and the transmission plate from incapability of position restoration.

DETAILED DESCRIPTION OF THE INVENTION

Figure 1:
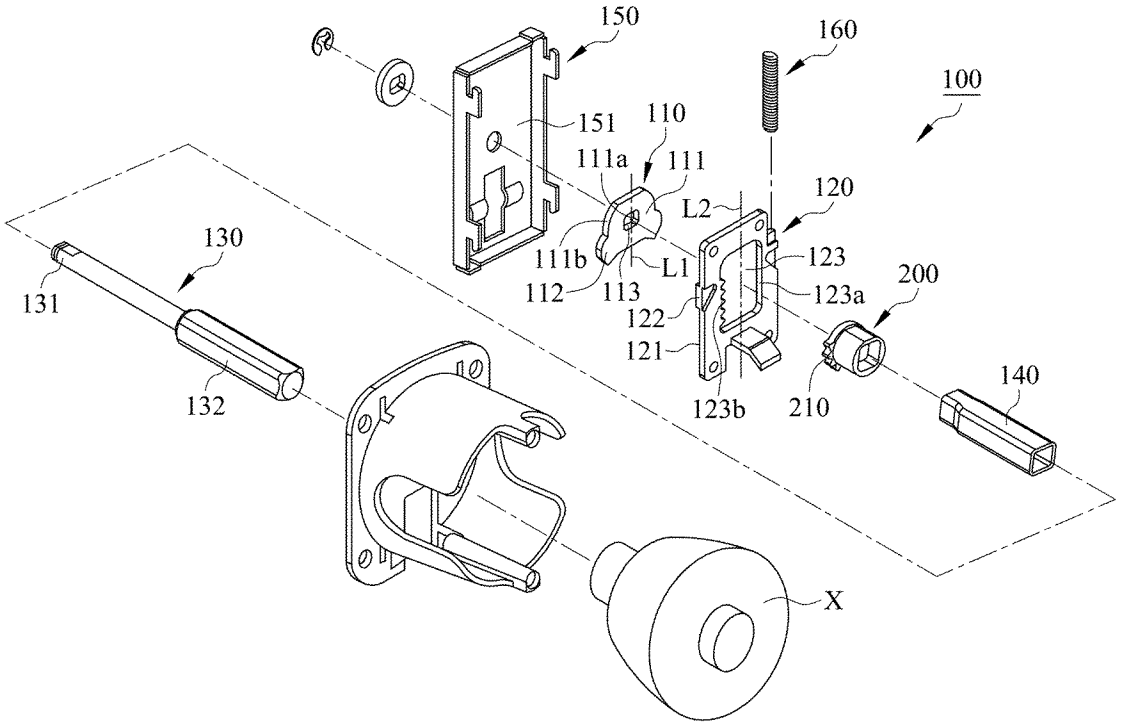
FIG. 1 is a perspective exploded diagram illustrating a transmission mechanism of a handle lock set in the present invention.
Figure 2:
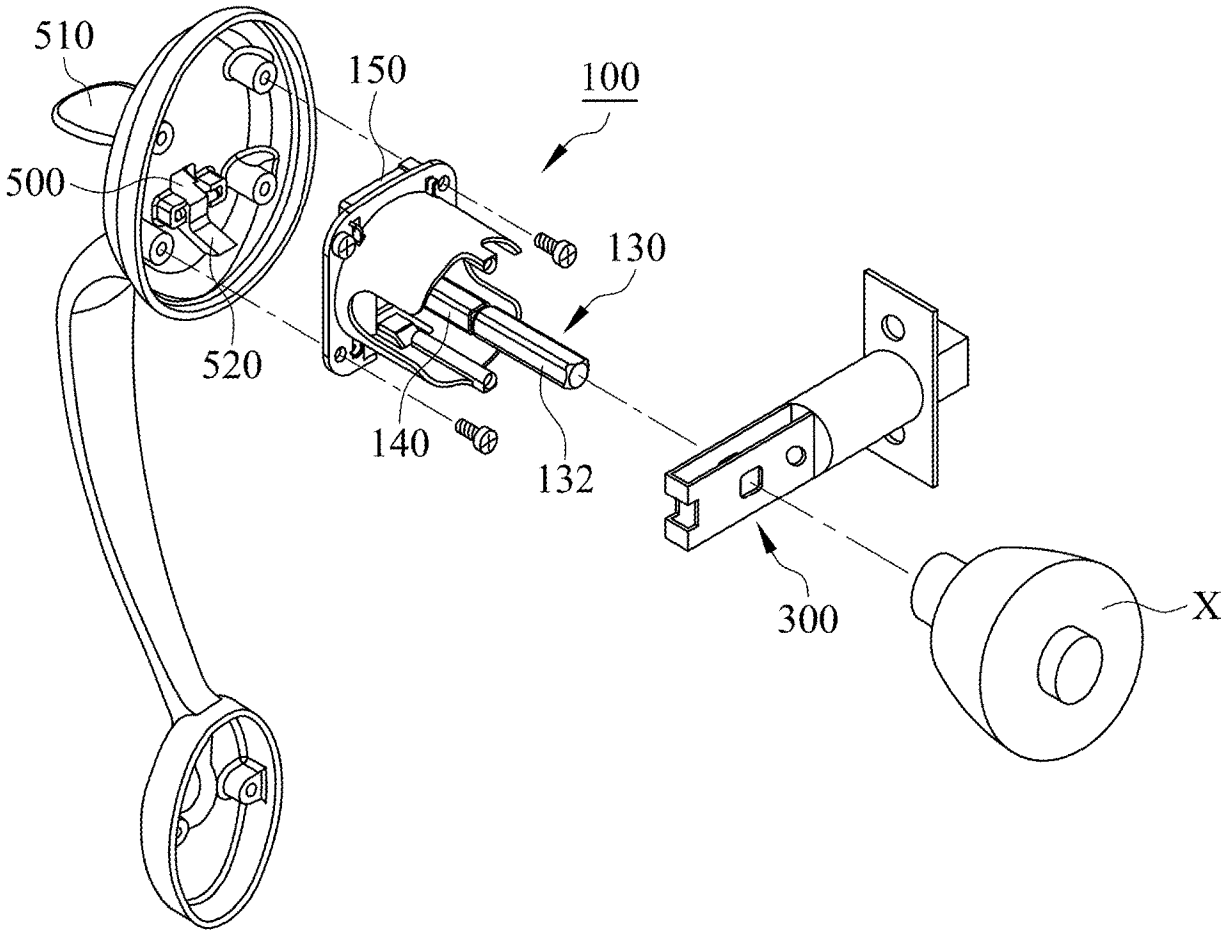
FIG. 2 is a perspective assembly diagram illustrating the transmission mechanism of the handle lock set in the present invention.

With reference to FIGS. 1 and 2, a transmission mechanism 100 of a handle lock set in accordance with an embodiment of the present invention includes a driving plate 110 and a transmission plate 120, wherein the driving plate 110 is used for driving the transmission plate 120 to move horizontally or vertically. In this embodiment, the present invention is illustrated by the transmission plate 120 moves in vertical mode. A rotating member 200 is driven to rotation therefore simultaneously driving a latch 300 to perform an expansion action or a retraction action when the transmission plate 120 moves vertically. The latch 300 is in an expansion state when a door is closed, and the door is able to open when the latch 300 is in a retraction state.

Figure 3:
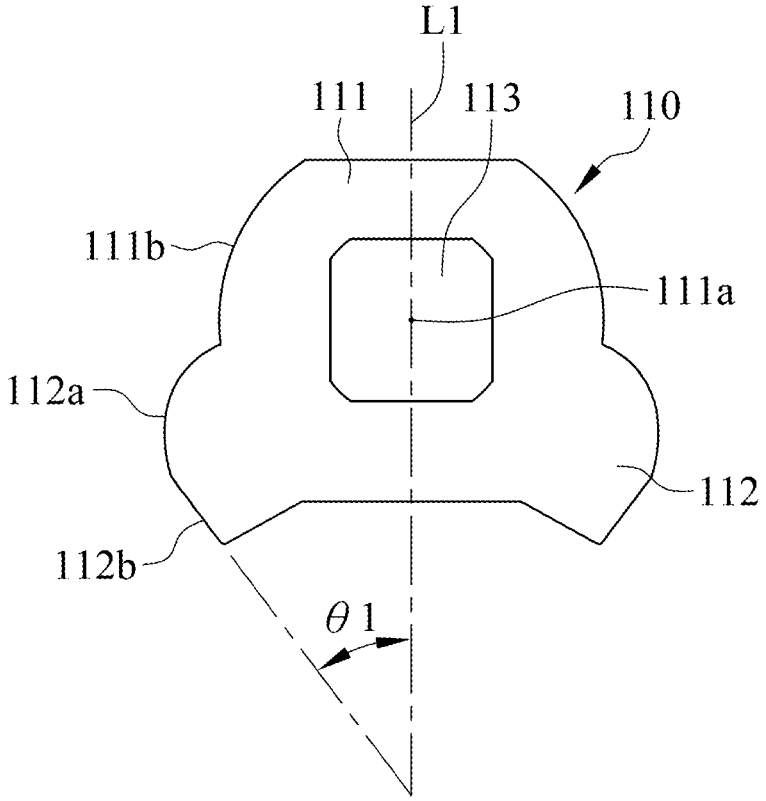
FIG. 3 is a front view illustrating a driving plate in the present invention.

With reference to FIGS. 1 and 3, the driving plate 110 comprises a main portion 111 and at least one supporting portion 112, wherein the main portion 111 comprises a rotational center 111*a* and a lateral wall 111*b*. In this embodiment, the driving plate 110 further comprises a through hole 113 and a first center line L1, wherein the through hole 113 penetrates the main portion 111, the rotational center 111*a* is located in the through hole 113, and the first center line L1 passes through the rotational center 111*a*. The supporting portion 112 protrudes to the lateral wall 111*b* and comprises a transmission surface 112*a* and a blocking surface 112*b*, the transmission surface 112*a* is located between the blocking surface 112*b* and the lateral wall 111*b*, and wherein the transmission surface 112*a* is an arc surface and the blocking surface 112*b* is a flat surface. A first included angle θ1 is defined between the blocking surface 112*b* and the first center line L1. The driving plate 110 rotates about the rotational center 111*a* for making the supporting portion 112 swinging between a first position (Referring to FIG. 6) and a second position (Referring to FIG. 7).

Figure 4:
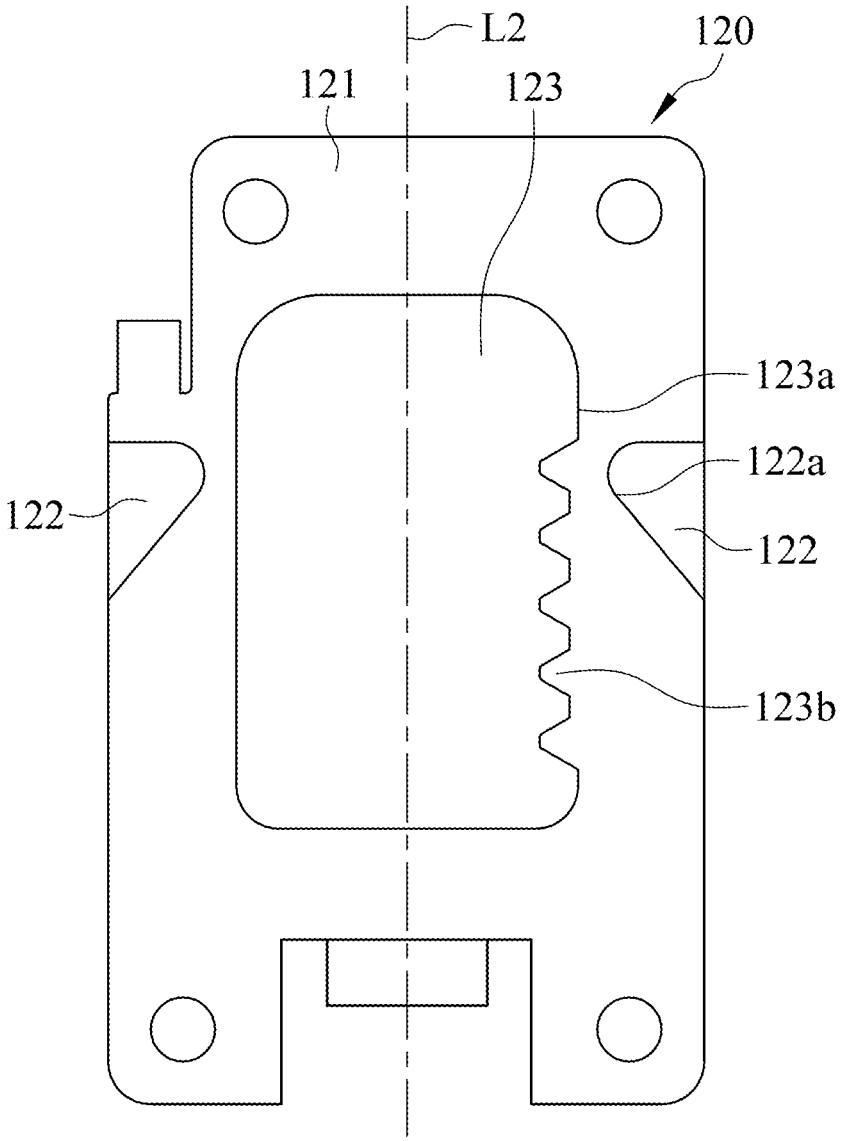
FIG. 4 is a front view illustrating a transmission plate in the present invention.
Figure 5:
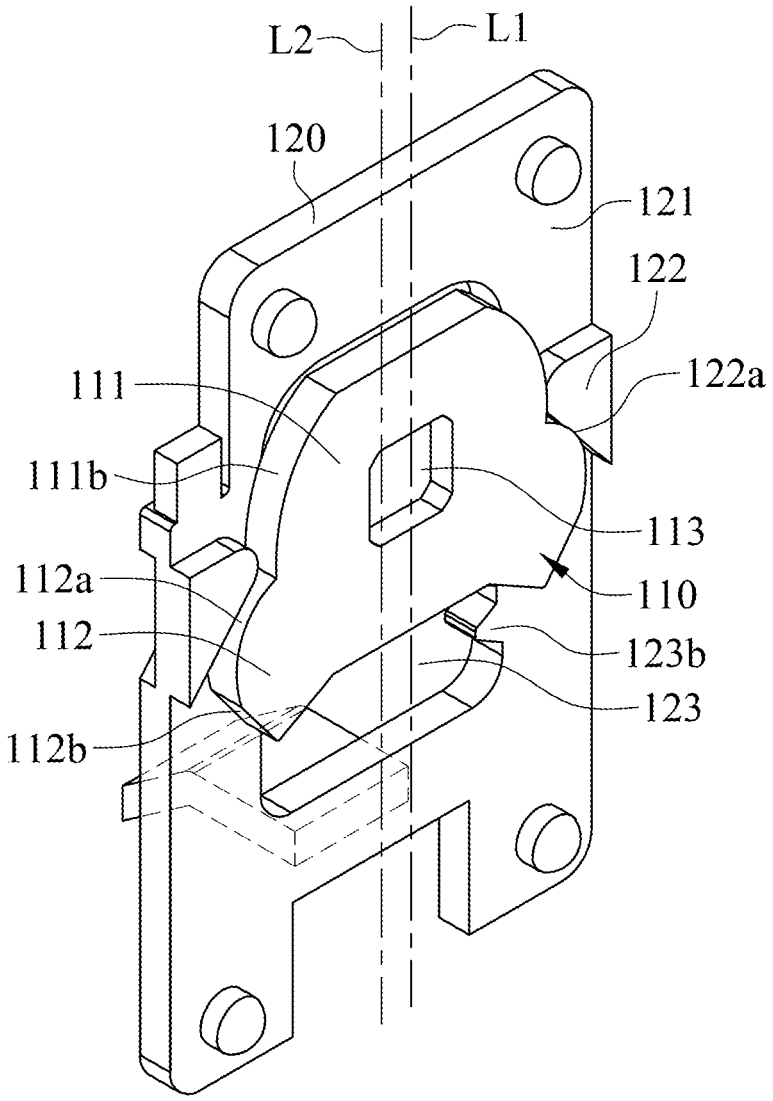
FIG. 5 is a perspective assembly diagram illustrating the driving plate and the transmission plate in the present invention.

With reference to FIGS. 1, 4 and 5, the transmission plate 120 comprises a first surface 121 and at least one protrusion 122 protruded to the first surface 121. With reference to FIGS. 4 and 5, the protrusion 122 comprises a contact surface 122*a* selectively contacts against the transmission surface 112*a* or the blocking surface 112*b*.

Figure 10:
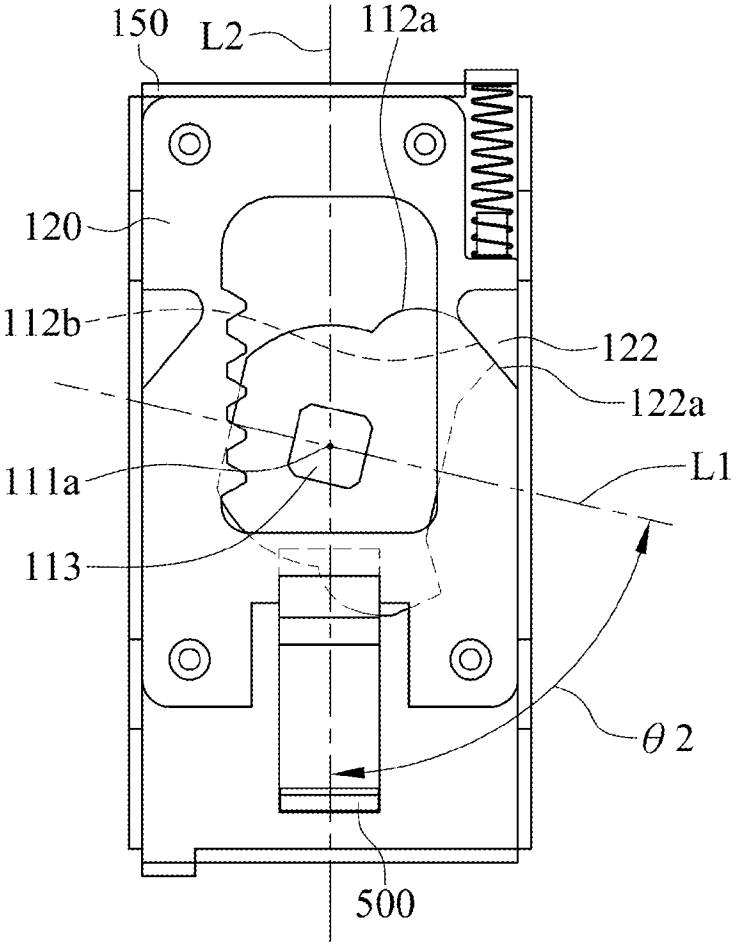
Figure 13:
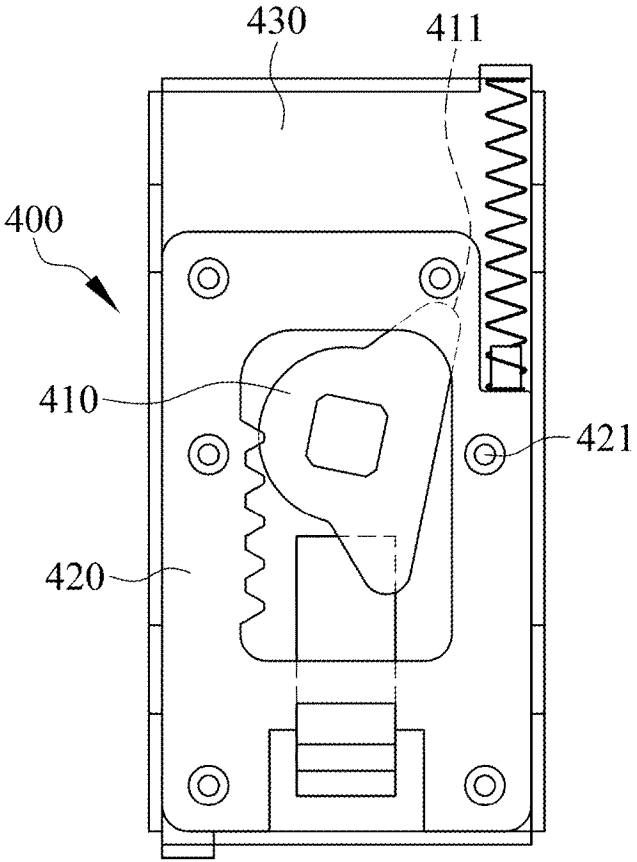
FIG. 13 PRIOR ART
Figure 12:
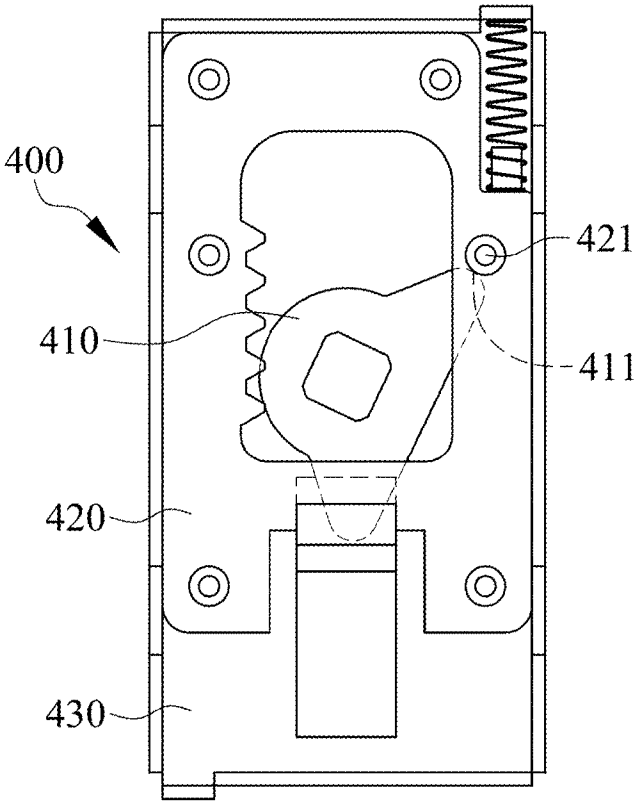
FIG. 12 PRIOR ART

With reference to FIG. 4, in this embodiment, the transmission plate 120 further comprises an opening 123 and a second center line L2, wherein a first gear portion 123*b* is formed at an opening wall 123*a* of the opening 123. Referring to FIG. 1, the rotating member 200 comprises a second gear portion 210, and the first gear portion 123*b* is engaged with the second gear portion 210. Therefore, the rotating member 200 is driven to rotate simultaneously when the transmission plate 120 is in operation. In this embodiment, the transmission plate 120 is movable between a door-closed position (Referring to FIGS. 6 and 8) and a door-opened position (Referring to FIGS. 7 and 10) for driving the rotating member 200 in rotation.

With reference to FIG. 5, in this embodiment, the driving plate 110 is disposed at outer side of the first surface 121 of the transmission plate 120, and the supporting portion 112 of the driving plate 110 is located beneath the protrusion 122. With reference to FIG. 1, the transmission mechanism 100 of handle lock set further includes a driving rod 130 and a transmission tube 140, wherein the driving rod 130 comprises a first end portion 131 and a second end portion 132. The transmission tube 140 is engaged with the rotating member 200, the driving rod 130 penetrates through the transmission tube 140 and the rotating member 200, the first end portion 131 of the driving rod 130 is engaged with the driving plate 110, the driving rod 130 is rotatable within the transmission tube 140, the transmission tube 140 and the rotating member 200 do not interfere with rotation of the driving rod 130. In this embodiment, the first end portion 131 of the driving rod 130 is engaged with the through hole 113 of the driving plate 110, the second end portion 132 is engaged with a handle X, wherein the handle X is able to drive the driving rod 130 in rotation and makes the driving rod 130 drive the driving plate 110 swinging.

Figure 6:
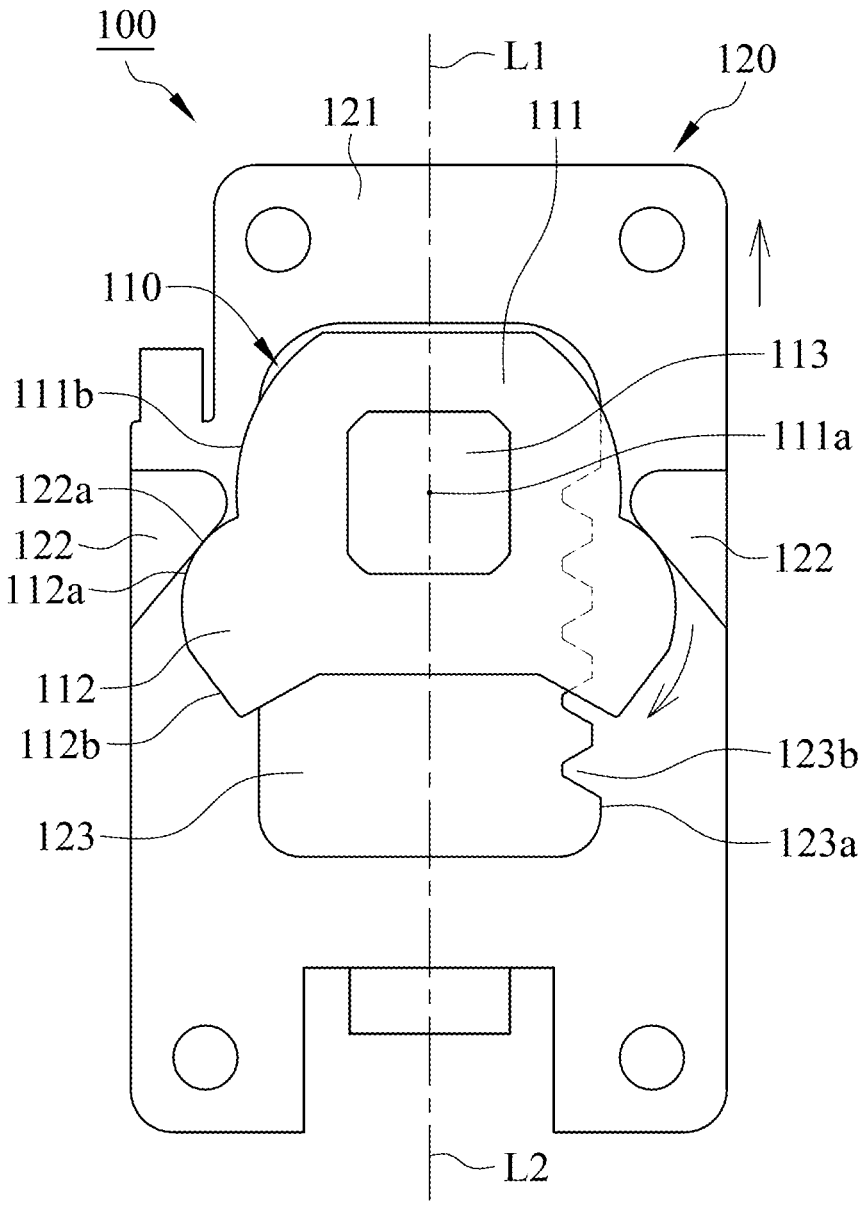
FIG. 6 is a front view illustrating combination of the driving plate and the transmission plate in the present invention.

With reference to FIGS. 1 and 6, in this embodiment, the transmission mechanism 100 of the handle lock set further includes a cover 150 and an elastic member 160, wherein the cover 150 comprises an accommodating slot 151. The driving plate 110 and the transmission plate 120 are disposed in the accommodating slot 151, the driving plate 110 is located between the cover 150 and the transmission plate 120, and two ends of the elastic member 160 contact against the transmission plate 120 and the cover 150 respectively. With reference to FIGS. 6, 7, 8 and 10, the elastic member 160 enables to push the transmission plate 120 for making the transmission plate 120 return to original position when the transmission plate 120 moves from the door-closed position (Referring to FIGS. 6 and 8) to the door-opened position (Referring to FIGS. 7 and 10).

With reference to FIGS. 1, 2, 5, 6 and 8, the supporting portion 112 is located at the first position when the driving rod 130 does not drive the driving plate 110 in rotation. At the same time, the transmission surface 112*a* of the supporting portion 112 contacts against the contact surface 122*a* of the protrusion 122, the transmission plate 120 is located at the door-closed position, the latch 300 is in extension state, and the first center line L1 of the driving plate 110 is parallel to the second center line L2 of the transmission plate 120.

Figure 7:
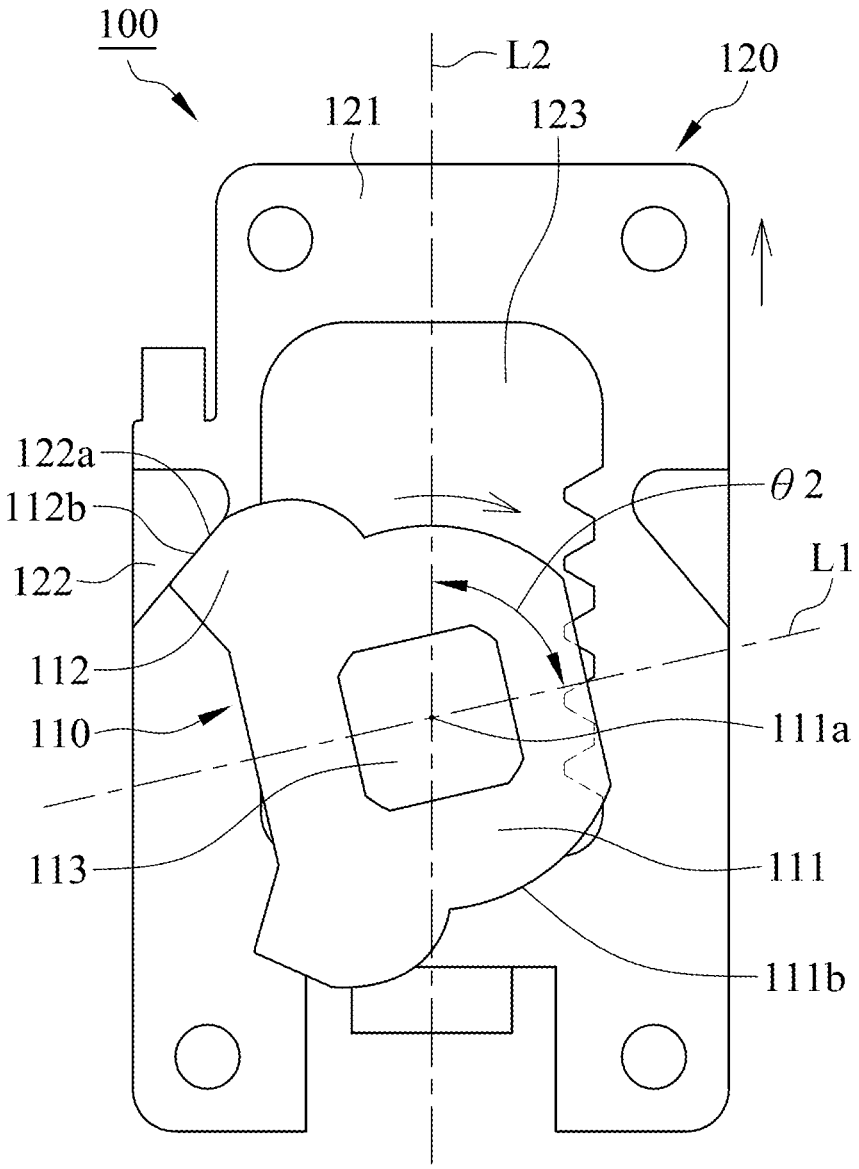
FIG. 7 is a front view illustrating combination of the driving plate and the transmission plate in the present invention.

With reference to FIG. 7, the supporting portion 112 is located at the second position when the driving rod 130 drives the driving plate 110 to rotate to a predetermined position. The blocking surface 112*b* of the supporting portion 112 contacts against the contact surface 122*a* of the protrusion 122, the transmission plate 120 is pushed by the driving plate 110 to move from the door-closed position to the door-opened position, and a second included angle θ2 is defined between the first center line L1 of the driving plate 110 and the second center line L2 of the transmission plate 120.

The present invention utilizes the transmission mechanism 100 of the handle lock set to drive the latch 300 perform retraction/extension action, which is operable by a handle at internal side of a door or by a compression plate at external side of the door. First, with reference to FIGS. 8 to 10, which describe the operation of the handle at internal side of the door.

Figure 8:
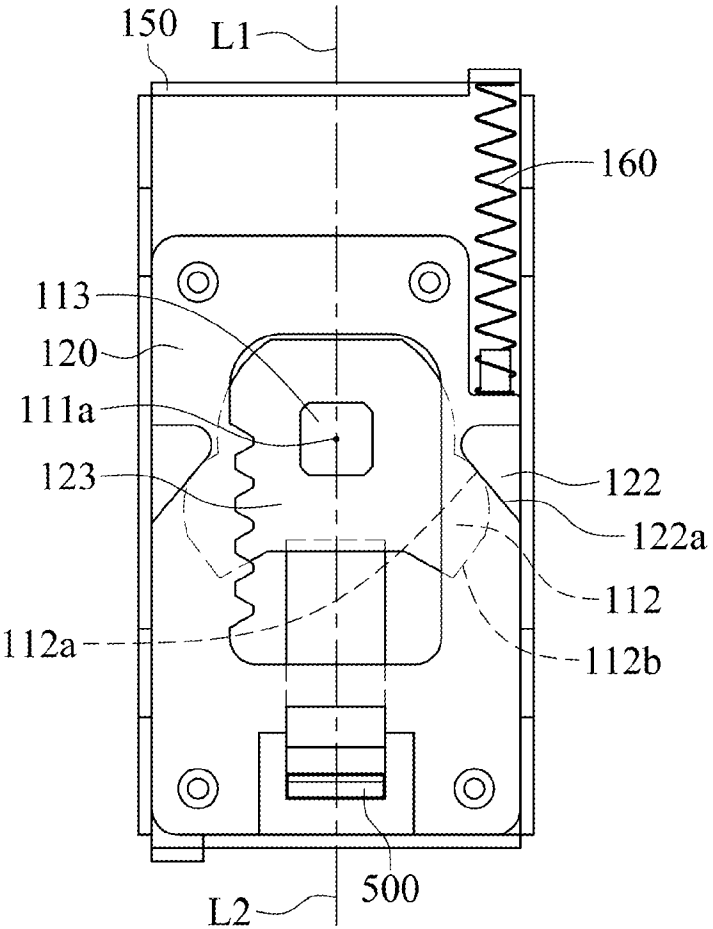
Figure 11:
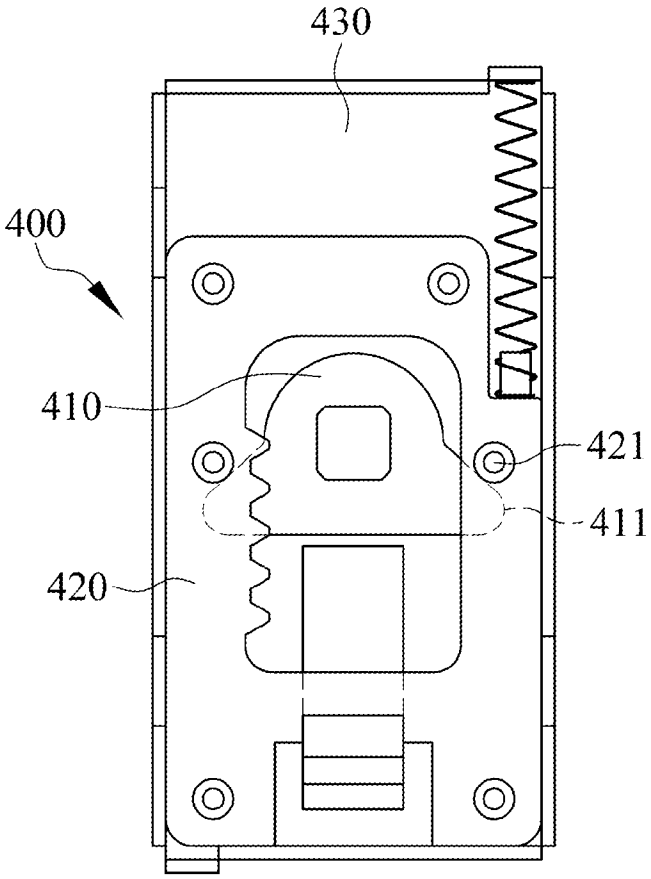
FIG. 11 PRIOR ART
FIGS. 11 to 13 are action diagrams illustrating conventional driving plate and transmission plate.

First, referring to FIGS. 1, 6 and 8, the supporting portion 112 of the driving plate 110 is located at the first position, and the transmission plate 120 is located at the door-closed position, and the transmission surface 112*a* of the supporting portion 112 contacts against the contact surface 122*a* of the protrusion 122 when the handle X does not drive the driving rod 130 in rotation.

Figure 9:
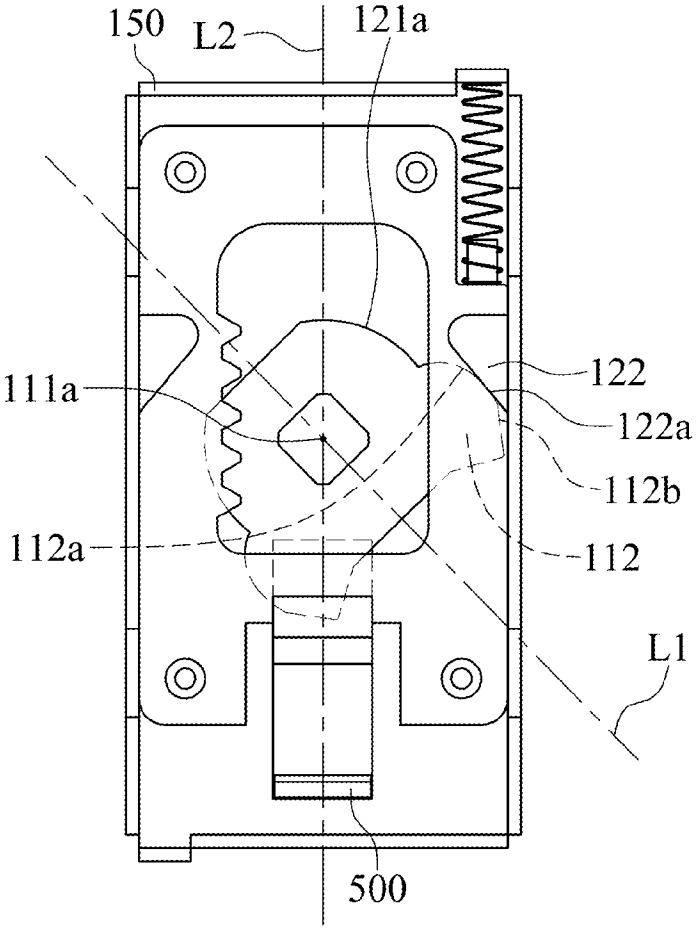
FIGS. 8 to 10 are action diagrams illustrating the driving plate and the transmission plate in the present invention.

Next, referring to FIGS. 1 and 9, external forces drive the handle X to make the handle X driving the driving rod 130 in rotation, the driving rod 130 simultaneously drives the driving plate 110 rotating about the rotational center 111*a* and makes the supporting portion 112 of the driving plate 110 swinging from the first position (Referring to FIGS. 6 and 8) to the second position (Referring to FIG. 7). The supporting portion 112 pushes the contact surface 122*a* of the protrusion 122 by the transmission surface 112*a* and makes the transmission plate 120 moved upwardly. Owing to the contact surface 122*a* is an arc surface, the contact surface 122*a* enable to prevent the driving plate 110 from being unavailable due to transmission dead spot occurrence when the supporting portion 112 pushes the protrusion 122. Besides, the forces rotating the handle X can be effectively saved owing to the reason that the transmission surface 112*a* is the arc surface.

With reference to FIGS. 1, 2, 4 and 5, in this embodiment, owing to the reason that the first gear portion 123*b* of the transmission plate 120 is engaged with the second gear portion 210 of the rotating member 200 and the transmission tube 140 is engaged with the rotating member 200, the driving plate 110 drives the rotating member 200 and the transmission tube 140 in rotation simultaneously when the transmission plate 120 is pushed by the driving member 110 to move upwardly. The latch 300 is driven to perform retraction/extension action by the transmission tube 140 in rotation.

Thereafter, referring to FIGS. 1, 2, 7 and 10, the blocking surface 112*b* of the supporting portion 112 contacts against the contact surface 122*a* of the protrusion 122 and the second included angle θ2 is defined between the second center line L2 of the transmission plate 120 and the first center line L1 of the driving plate 110 when the driving plate 110 is driven by the driving rod 130 for making the supporting portion 112 swinging to the second position. In this embodiment, the second included angle θ2 is larger than the first included angle θ1. The transmission plate 120 is pushed by the driving plate 110 to move from the door-closed position to the door-opened position and drives the rotating member 200 in rotation, and the rotating member 200 simultaneously drives the transmission tube 140 in rotation. The latch 300 is driven to perform a retraction state by the transmission tube 140 in rotation, and the elastic member 160 is compressed by the transmission plate 120 to perform a compressed state. In this embodiment, owing to the reason that the supporting portion 112 contacts against the contact surface 122*a* of the protrusion 122 by the blocking surface 112*b*, over rotation of the transmission plate 110 can be avoided to prevent the driving plate 110 from incapability of restoration.

Eventually, referring to FIGS. 1, 6 and 8, the elastic member 160 provides return force to push the transmission plate 120 to return to the door-closed position (Referring to FIGS. 6 and 8) from the door-opened position (Referring to FIGS. 7 and 10), and the supporting portion 112 of the transmission plate 110 returns to the first position (Referring to FIGS. 6 and 8) from the second position (Referring to FIGS. 7 and 10) to make the transmission plate 120 driving the rotating member 200 and the transmission tube 140 in rotation when the external force does not continuously drive the handle X. The latch 300 is driven by the transmission tube 140 to return to the retraction state.

With reference to FIGS. 1, 2 and 8, in this embodiment, the latch 300 performs retraction/extension action by a compression plate 500 at external side of the door as well, wherein the compression plate 500 comprises a pressing portion 510 and a pushing portion 520. The pushing portion 520 pushes the transmission plate 120 move upwardly when the pressing portion 510 is compressed by external forces to make the transmission plate 120 moving from the door-opened position to the door-closed position and further drives the rotating member 200 in rotation. The rotating member 200 drives the transmission tube 140 in rotation simultaneously. The latch 300 is driven to perform a retraction state by the transmission tube 140 in rotation. Besides, owing to the reason that the transmission tube 140 and the rotating member 200 do not interfere with rotation of the driving rod 130, therefore, the driving plate 110 and the driving rod 130 do not rotate when the compression plate 500 drives the latch 300 to perform the retraction action. Accordingly, the force that compresses the compression plate 500 can be effectively saved.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A transmission mechanism of a handle lock set used for driving a latch to perform extension/retraction action comprising:

a driving plate having a main portion and a supporting portion, wherein the main portion comprises a rotational center, the supporting portion comprises a transmission surface and a blocking surface, the transmission surface is an arc surface, the blocking surface is a flat surface, the driving plate rotates about the rotational center to make the supporting portion swing between a first position and a second position;

a rotating member; and a transmission plate having a first surface and a protrusion protruding from the first surface, wherein the protrusion comprises a contact surface wherein the contact surface is flat, the transmission plate is movable between a door-closed position and a door-open position to drive the rotating member in rotation and drive the latch simultaneously by the rotating member, the transmission surface of the supporting portion contacts against the contact surface, and the transmission plate is moved to the door-closed position, and the latch is in an extension state when the supporting portion of the driving plate is located at the first position; the blocking surface of the supporting portion contacts against the contact surface of the protrusion, and the transmission plate is pushed by the driving plate to move from the door-closed position to the door open position and drives the rotating member in rotation for making the latch operate in a retraction state when the supporting portion of the driving plate swings to the second position.

2. The transmission mechanism of a handle lock set in accordance with claim 1, wherein the driving plate comprises a first center line passing through the rotational center, and a first included angle is defined between the blocking surface and the first center line.

3. The transmission mechanism of a handle lock set in accordance with claim 1, wherein the driving plate comprises a through hole penetrating the main portion, and the rotational center is located within the through hole.

4. The transmission mechanism of a handle lock set in accordance with claim 2, wherein the transmission plate comprises a second center line, the first center line is parallel to the second center line when the supporting portion is located at the first position, a second included angle is defined between the second center line and the first center line when the supporting portion is located at the second position, and wherein the second included angle is larger than the first included angle.

5. The transmission mechanism of a handle lock set in accordance with claim 1, wherein the transmission plate comprises an opening, a first gear portion is formed at an opening wall of the opening, the rotating member comprises a second gear portion, and the first gear portion is engaged with the second gear portion.

6. The transmission mechanism of a handle lock set in accordance with claim 1 further includes a cover and an elastic member, wherein two ends of the elastic member contact against the transmission plate and the cover respectively.

7. The transmission mechanism of a handle lock set in accordance with claim 6, wherein the cover comprises an accommodating slot, the driving plate and the transmission plate are disposed in the accommodating slot.

8. The transmission mechanism of a handle lock set in accordance with claim 3 further includes a driving rod and a transmission tube, wherein the driving rod comprises a first end portion and a second end portion, the transmission tube is engaged with the rotating member, the driving rod penetrates the transmission tube and the rotating member, the first end portion of the driving rod is engaged with the driving plate, the driving rod is rotatable in the transmission tube, wherein the transmission tube and the rotating member do not interfere with rotation of the driving rod.

9. The transmission mechanism of a handle lock set in accordance with claim 8, wherein the first end portion of the driving rod is engaged with the through hole of the driving plate.

10. The transmission mechanism of a handle lock set in accordance with claim 1 further includes a compression plate, wherein the driving plate does not interact with the transmission plate when the compression plate drives the transmission plate to move from the door-closed position to the door-opened position.

* * * * *